US005215107A

United States Patent [19]

Van Divner

[11] Patent Number: 5,215,107

[45] Date of Patent: Jun. 1, 1993

[54] SPIRAL HAIR CURLER

[76] Inventor: Linda J. Van Divner, 13297 W. 111th Ter., Overland Park, Kans. 66210

[21] Appl. No.: 883,277

[22] Filed: May 14, 1992

[51] Int. Cl.[5] ..... A45D 2/14

[52] U.S. Cl. ..... 132/248; 132/250; 132/254; 132/268

[58] Field of Search ..... 132/245, 247, 248, 250, 132/254, 268

[56] References Cited

U.S. PATENT DOCUMENTS

| | | | |
|---|---|---|---|
| 731,861 | 6/1903 | Connell | 132/248 |
| 1,377,655 | 5/1921 | Begas | 132/268 |
| 2,783,763 | 3/1957 | King | 132/268 |
| 2,847,015 | 8/1958 | Davis | 132/250 |
| 3,080,873 | 3/1963 | Feist | 132/250 |
| 4,211,245 | 7/1980 | Coppola et al. | 132/268 |
| 4,249,550 | 2/1981 | Cassidy | 132/268 |
| 4,258,732 | 3/1981 | Mariani et al. | 132/268 |
| 4,284,091 | 8/1981 | Ehmann | 132/268 |
| 4,699,160 | 10/1987 | Wiggin | 132/248 |
| 4,732,169 | 3/1988 | Van Sickle | 132/248 |

FOREIGN PATENT DOCUMENTS

| | | | |
|---|---|---|---|
| 1265773 | 5/1961 | France | 132/248 |
| 0022711 | of 1907 | United Kingdom | 132/248 |
| 2005137 | 4/1979 | United Kingdom | 132/254 |

*Primary Examiner*—Gene Mancene
*Assistant Examiner*—Frank A. LaViola
*Attorney, Agent, or Firm*—Hovey, Williams, Timmons & Collins

[57] ABSTRACT

The curler has a generally cylindrical body provided with a rib that winds helically from one end to the opposite end of the body to define a recessed guide channel within which a gathered strand of hair is received when the curler is placed in use. An elastic retaining band stretches from one end of the curler across and against the outermost ridges of the adjacent convolutions of the rib so as to trap the hair strand within the recessed guide channel so as to prevent damaging pressure contact between the retaining band and the strand. In order to apply the curler to the hair strand, the strand is initially pulled generally taut and is wrapped for at least one full convolution onto a rib-free, smooth portion adjacent one end of the curler so as to overlap the free outer end of the strand and keep it from coming loose after the strand has been fully applied to the curler. By then sinning the curler about the longitudinal axis of the curler and angling the curler body slightly relative to the strand, the strand will be quickly and easily guided into the channel as the strand coils around the curler.

6 Claims, 3 Drawing Sheets

SPIRAL HAIR CURLER

TECHNICAL FIELD

The present invention relates to hair curlers of the type utilized in a hair styling process sometimes known as "perming" so as to produce stylish, long-lasting curls in an individual's head of hair. Typically, such curlers are referred to as "perm rods", and in particular, the present invention relates to so-called spiral perm rods used to produce rather long, helical curls in the hair.

BACKGROUND

Spiral perm rods have been available for some time, but current designs are awkward to use, easily loosen up in the hair to produce poor quality curls, and slow down the operator considerably because of their inferior design. Consequently, there is a general trend away from spiral rods, even though a good-looking, spiral curl is quite popular and highly sought after. As a consequence, in order to save time, may operators use so-called straight perm rods which are actually intended to be used for curls having convolutions which are simply wrapped up on top of one another in multiple layers, rather than stretched out in a single-layered, helical pattern. While straight rods are usable for producing spiral curls, they, too, are not ideal and tend to produce a lower quality end result.

SUMMARY OF THE PRESENT INVENTION

Accordingly, one important object of the present invention is to provide a spiral perm rod which is much easier and faster to use than current spiral rods and which produces better results. At the same time, it is an important object of the present invention to provide a novel method of making spiral curls that greatly facilitates and accelerates the preparation of high quality curls compared to prior techniques.

In carrying out the foregoing and other important objects, the present invention contemplates providing an elongated, generally cylindrical curler body molded from plastic or the like and having a helical rib that extends from a point adjacent one end of the curler to the extremity at the opposite end of the curler so as to present a helical guide channel which winds around the curler between adjacent ridges of the rib. Instead of clips or the like typically found in the prior art, the present invention utilizes an elastic band retainer that is used to confine the curled strands of hair within the guide channel of each curler after the curler has been applied to the hair. The elastic band usually does not directly contact the convolutions of the curls because they are nested deeply within the recessed guide channels on the curler while the elastic band lies across the outer ridges of the channels to avoid contacting the curls except in the endmost regions. Such avoidance of contact is particularly advantageous where the hair has been treated with perming solutions and conditioners and is thus quite soft and fragile, while also being swelled up, such that the hair would be easily crimped if direct pressure were applied by an external device of some sort. Once the hair is dried, it could be brittle at the point of the crimp, resulting in breakage of the hair at that location. In its preferred form, the elastic retainer has a cap at its free end which is removably insertable within a receiving socket at a corresponding end of the curler to hold the retainer in its curl retaining position extending along the outer ridges of the channels.

In accordance with my novel method, a strand of hair is started on the curler at the outer, free end of the strand, rather than at the inner end, close to the scalp, as in prior techniques. A smooth, rib-free cylindrical area on one end of the curler is first wrapped completely around by the free end so that the end is overlapped by a portion of the next convolution, thus effectively holding the free end in place on the curler. Then, the curler is merely rolled or rotated about its longitudinal axis while the strand is guided into the channel such that the strand winds up helically on the curler until reaching the opposite end of the curler, which by this time should be fairly close to the scalp. Then the elastic retainer is applied to hold the curler in place and other steps of the perming process can be carried out. It will be noted that by starting the curl at the outer end of the strand and finishing up next to the scalp with an effective retainer in place, the curler has little tendency to come loose, so that an attractive, well-formed spiral curl can be produced. Moreover, the sometimes difficult to handle outer tip end of the hair strand is well controlled using this technique and caused to assume the shape intended for it, rather than allowing the tip to assume some rather erratic position during the perming process, which obviously could lead to highly unsatisfactory results and dissatisfied customers where the perming process is being carried out commercially.

BRIEF DESCRIPTION OF THE DRAWINGS

FIG. 1 is an upright perspective view of a spiral perming rod or curler constructed in accordance with the present invention and illustrating the elastic retainer detached from its receiving socket;

DETAILED DESCRIPTION

Figure 2:
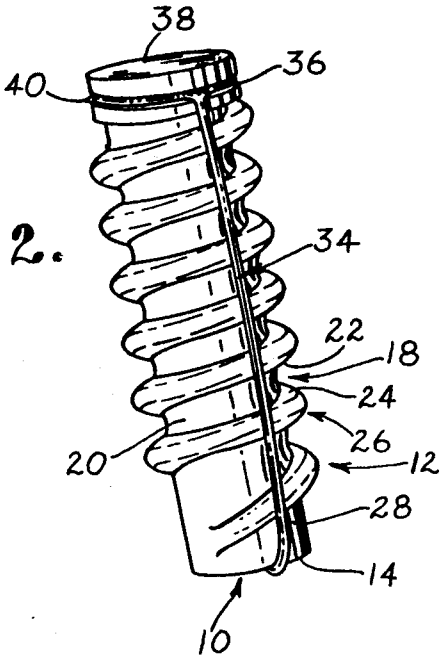
FIG. 2 is a perspective view similar to FIG. 1, but showing the retainer band secured in its curl retaining position.
Figure 3:
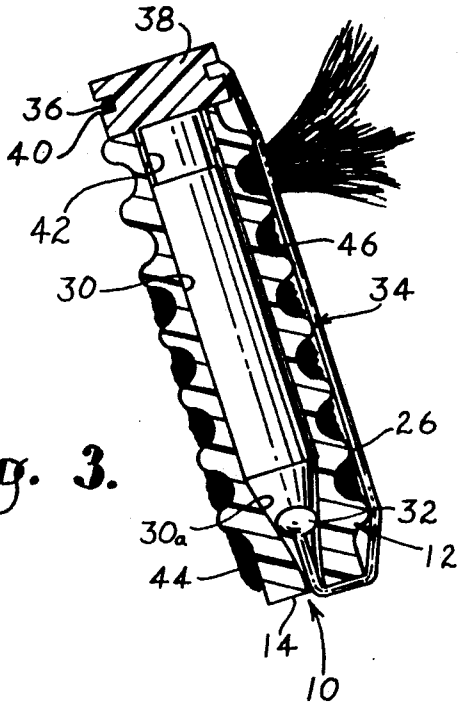
FIG. 3 is a longitudinal cross-sectional view through the rod with the retaining band in place and illustrating the manner in which the individual curls in the strand are protectively nested down within the spiral guide channel of the rod to be substantially out of damaging contact with the retaining band.
Figure 4:
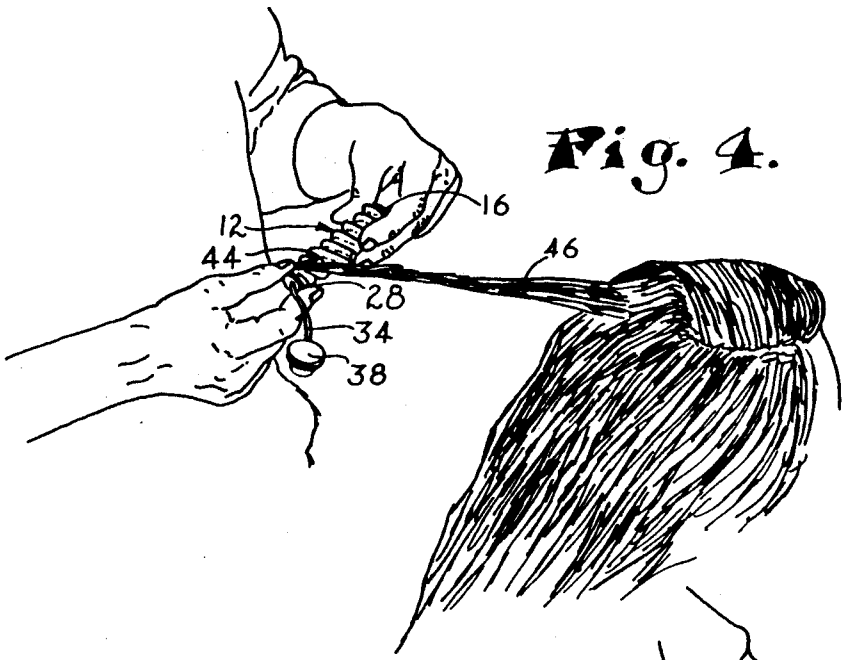

As illustrated in FIGS. 1–3, the spiral curler or rod of the present invention has an elongated, generally cylindrical body 10 which is provided with a single, continuous rib 12 that winds helically from a point adjacent one end 14 of the body 10 to a point closely adjacent the opposite end 16 of the body 10. In the course of winding helically around the body 10, the rib 12 produces a helically extending, recessed guide channel 18 that extends the full length of the rib 12. The guide channel 18 is generally transversely U-shaped, having a floor 20 presented by the exposed portion of the body 10, and a pair of upstanding sides 22 and 24 presented by adjacent convolutions of the rib 12. Outermost ridges 26 on adjacent convolutions of the rib 12 are spaced laterally outwardly from the floor 20.

The rib 12 commences at a point spaced somewhat inboard from the exact extremity of the lower end 14 of the body 10 so as to produce a rib-free, smooth cylindrical portion 28. At the opposite, upper end 16 of the body 10, the rib 12 preferably extends to the complete extremity of the end 16 inasmuch as there is no need for the smooth portion 28, as will hereinafter be explained in more detail.

Preferably, the body 10 and the rib 12 comprise portions of a single, integrally molded plastic component to facilitate manufacture. As illustrated in FIG. 3, the body 10 is preferably hollow, having a mostly cylindrical inner bore 30 extending from the upper end 16 completely through the body 10 until reaching the opposite lower end 14. Adjacent the lower end 14 the bore has a tapered, conical section 30*a* so that at the lower extremity of the body 10, the bore 30 is of considerably constricted diameter relative to its diameter throughout the major portion thereof.

Such conical section 30*a* of the bore 30 is advantageously used to trap and wedgingly retain an enlargement 32, preferably of spherical configuration, secured to one end of an inherently resilient retainer band 34. The band 34 has at its opposite end a loop 36 (see FIG. 2 and also FIG. 3) that encircles an attaching cap 38 so as to secure the cap 38 to the band 34. An annular groove 40 within the periphery of the cap 38 receives the loop 36 so as to maintain a suitable connection between the later and the cap 38. The cap 38 has a reduced diameter, annular plug portion 42 on its underside which is adapted to removably, yet snugly fit into the open upper end of the body 10 which serves in the nature of a mating receiving socket for the plug portion 42. Preferably, the retaining band 34 is of such length that in order for the cap to be attached to the upper end 16 of the curler, the band 34 must be stretched somewhat and, when doing so, lies along and in contacting engagement with the adjacent ridges 26 of the rib 12, as illustrated in FIGS. 2 and 3.

Figure 4:
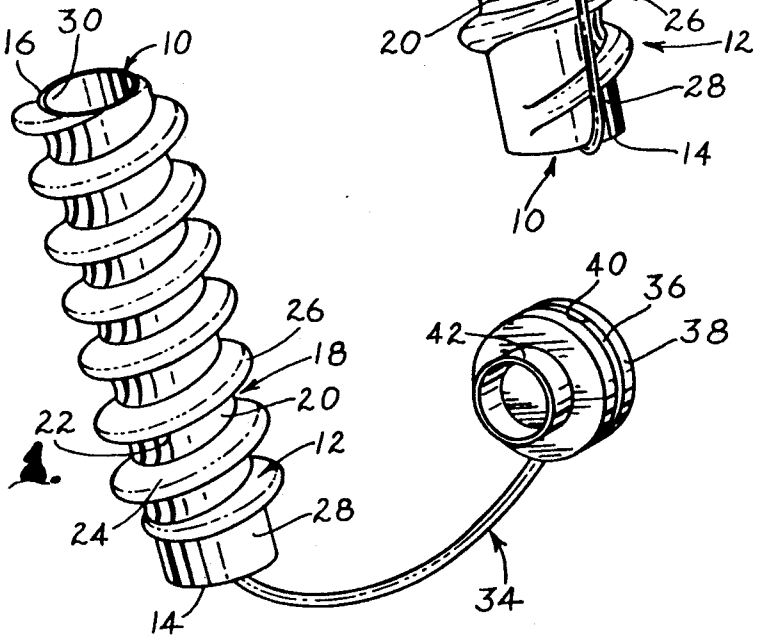
FIG. 4 is a perspective view illustrating one of the first steps in the spiral hair curling method of the present invention, such step including initially wrapping the free end of the hair around a rib-free portion of the curler at one end thereof while the hair is pulled generally taut.
Figure 5:
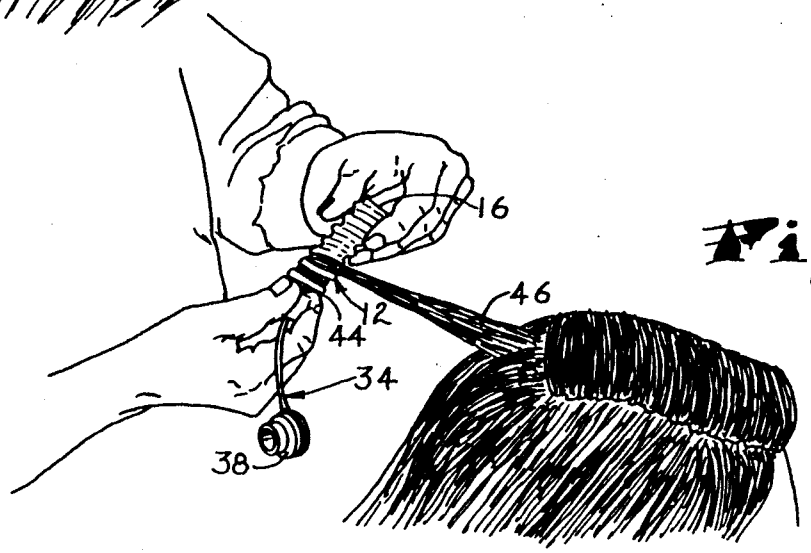
FIG. 5 is a perspective view illustrating a later step in the process as the strand of hair is being coiled onto the curler by rotating the curler about its longitudinal axis.
Figure 6:
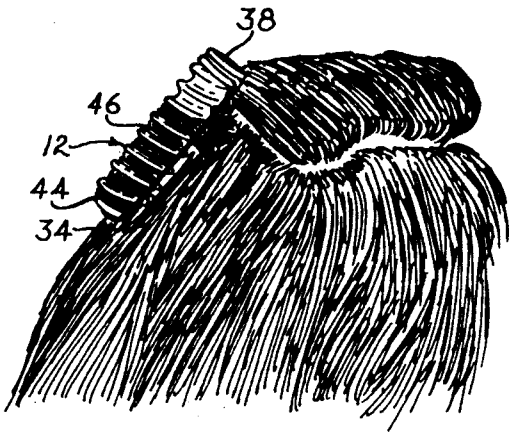
FIG. 6 is a perspective view of the finished curl securely wrapped onto the rod and held snuggly in place by the elastic retaining band for further processing.

In use, the curler of the present invention is designed to be advantageously applied to the hair in the manner illustrated in FIGS. 4, 5, and 6, as well as FIG. 3. Turning first to FIG. 4, and with the cap 38 removed from the upper end 16 of the curler and dangling freely by band 34 so as to be out of the way yet quickly and conveniently available for use, the outer free end 44 of a gathered strand of hair 46 is applied to the smooth, rib-free portion 28 of the curler. At this point, thin tissue papers may be used if desired to assist in securing the free end of the hair to the curler, but such usage is not required.

The outer end 44 of the hair strand is wrapped around the curler for at least one convolution, plus sufficient additional wrapping as to overlap the free end itself. Then, by angling the curler slightly while maintaining its longitudinal axis generally perpendicular to the strand 46, rotation of the curler about its longitudinal axis causes the strand 46 to enter the guide channel 18. Continued rotation of the curler in this manner, as now illustrated in FIG. 5, causes the strand 46 to progressively and helically coil up on the curler within the guide channel 18 until the length of the strand is used up and the curler lies up against the person's scalp. At that time, the cap 38 may simply be attached to the open end 16 of the curler by inserting the plug portion 42 into the bore 30, whereupon the stretched band 34 comes to rest across the outer ridges 26 of the guide channels 18 so as to trap the curls of the hair strand therewithin. This is illustrated in FIG. 6, and also in FIG. 3.

It will be appreciated that by starting at the outer end of the hair strand, it is very easy to simply twirl or spin the curler in the operator's fingers as the hair strand is coiled onto the curler. Consequently, the spiral curl can be applied to the curler very quickly and with only a minimum of effort. Moveover, because the retainer 34 remains connected to the curler body, yet out of the way during a time that the hair strand is being wrapped onto the curler, the retainer is immediately available without fumbling or searching when it is time to let go of the curler and leave it supported by the strand of hair.

Note, as illustrated, for example, in FIG. 3 that although the band 34 keeps the curls of the hair strand from slipping out of the guide channel, in reality there is very little if any contact between the band 34 and the hair strand, except at the upper endmost curl where it attaches to the scalp, and perhaps also to a slight extent at the outermost free end. Thus, the strand of hair is not crimped due to contacting pressure from the band, and yet snug securance of the curler to the person's head of hair is assured.

PRIOR ART

FIGS. 7–10 show a prior art spiral rod and its manner of use. Although the prior art rod 60 is not shown in complete detail, it will be seen that the rod 60 includes a generally cylindrical body 62 having a rib 64 which winds helically from one end to the opposite end thereof. In this respect, the prior art rod 60 is similar to the rod of the present invention, as illustrated in FIGS. 1–6.

Figure 8:
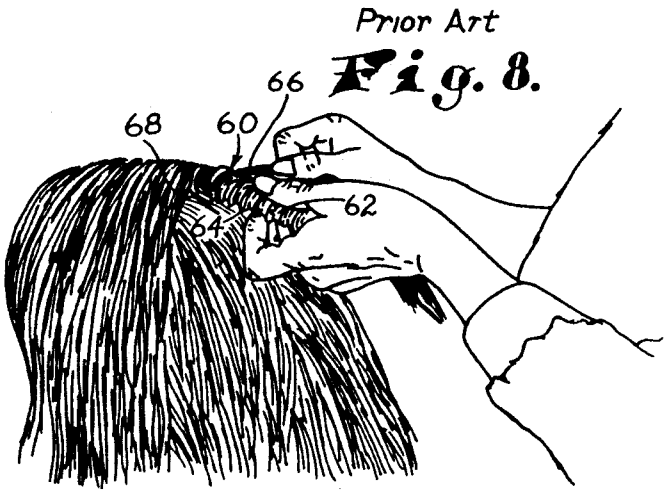
Prior Art Fig. 8.
FIGS. 7–10 are perspective views illustrating a certain prior art spiral perm rod and its manner of use.
Figure 7:
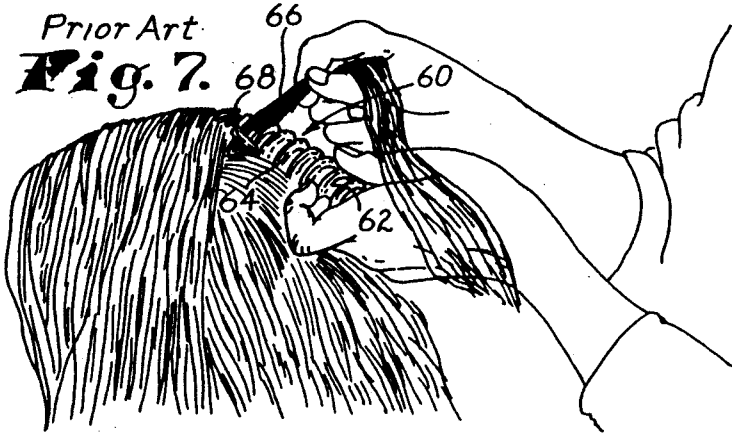
Prior Art Fig. 7.

However, the prior art rod 60 is designed to start wrapping the hair strand around the rod at a point near to the scalp, rather than out at the free end of the strand. Thus, as illustrated in FIG. 7, the strand 66 is initially placed on the normally upper end of the curler 60 and slipped under an integral retaining hook 68. The strand 66 is then wound around the curler 60 without rotating the curler 60, since the hook 68 is clamped against the strand near to the scalp to prevent such rotation. The strand must be manually wrapped around and around the curler 60 and slipped into the retaining grooves between adjacent convolutions of the rib in order to place the strand in the form of a curl on the curler. This is illustrated in FIGS. 7 and 8.

Figure 10:
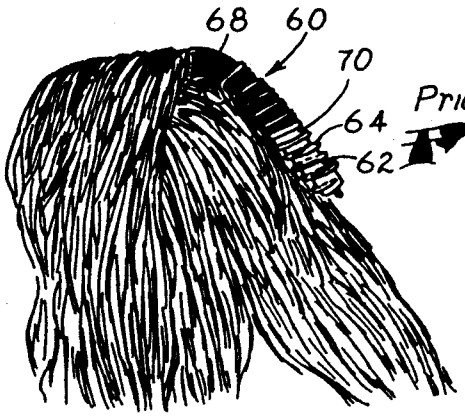
Prior Art Fig. 10.
Figure 9:
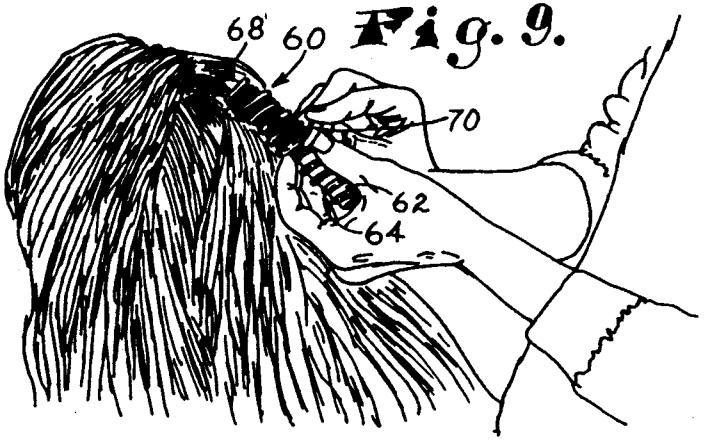
Prior Art Fig. 9.

After the hair strand has been fully wrapped around the curler 60, a separate, generally C-shaped spring clip 70 is slipped onto the curler 60, as illustrated in FIG. 9, such clip 70 embracing the body of the curler 60 between convolutions of the rib 64 in an effort to keep the loose terminal end of the hair strand in place on the curler 60. However, the hair strand tends to pull loose from the curler 60, not only after installation has been finally completed, as shown in FIG. 10, but also during the time that the operator must wrap the strand about the stationary curler. Any slight pulling on the curler tends to cause the strand to slip from under the retaining hook 68 and lengthen the portion of the strand between the hook 68 and the scalp, thus increasing the length that fails to be properly curled.

Moreover, the clip 70 is easily misplaced, and in the event the free end of the hair strand works loose from the clip 70, the free end of the hair will not be properly be held down in its controlled position and will instead become erratically and randomly positioned out of control. It will also be seen that the installation of the prior art spiral rod 60 is much slower and tedious than the spiral rod of the present invention, which is of particular significance when the process is being carried out on a commercial basis and the operator must make every minute count and must frequently deal with several different customers almost simultaneously.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states her intent to rely on the Doctrine of Equivalents to determine and assess the reasonably fair scope of her invention as pertains to any apparatus not materially departing from but outside the literal scope of the invention as set out in the following claims.

I claim:

1. A curler for use in producing spiral curls in a strand of human hair comprising:

an elongated, at least generally cylindrical body having a starting end for receiving the outer, free end of the hair strand and an opposite finishing end for receiving the inner end of the strand nearest the scalp;

means defining a spiral hair-receiving guide channel on said body leading helically from the starting end of the body toward the finishing end thereof for confining the strand of hair in a spiral curl when the strand is wrapped around the body, said channel including a recessed floor and outwardly projecting rib means on opposite sides of the floor having outermost ridges spaced from the floor, said starting end of the body having a non-ribbed curl starter area of constant diameter around which the initially free outer end of the hair strand may be wound in overlapping convolutions to assist in securing the free end of the strand to the curler, the diameter of the curler in the non-ribbed starter area of the body being less than the diameter of the curler across the ribs;

means defining an axially extending socket in the finishing end of the body;

a plug removably insertable into said socket; and an elastic retainer band connected between the plug and said starting end of the body so that as the curler is wound up into the hair strand beginning with the outer end of the strand wrapped around the starting end of the body, the plug and band may hang down out of the way below the body, and after the hair strand has been fully wound onto the curler the plug may be inserted into the socket to cause the strand to stretch across the rib means and retain the curled hair strand within the channel.

2. A curler as claimed in claim 1, said rib means comprising a single rib winding helically around the body.

3. A curler as claimed in claim 2, said rib being formed integrally with the body.

4. A curler as claimed in claim 1, said starting end of the body having an axially extending hole therein, said band having an enlargement thereon internally of the body having a transverse dimension larger than that of the hole whereby to prevent the band from becoming disconnected from the body.

5. A curler as claimed in claim 4, said hole in the starting end of the body being elongated to present an internally disposed, tapering bore which progressively decreases in cross-sectional configuration as said starting end of the body is approached, said enlargement on the band comprising a ball disposed to become wedgably retained within said bore when a pulling force is applied to the band.

6. A curler as claimed in claim 1, said body being hollow.

* * * * *